US009099810B2

(12) United States Patent
Ohmura

(10) Patent No.: US 9,099,810 B2
(45) Date of Patent: Aug. 4, 2015

(54) HALF FITTING PREVENTION CONNECTOR

(75) Inventor: Takenori Ohmura, Kakegawa-shi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/113,275

(22) PCT Filed: May 18, 2012

(86) PCT No.: PCT/JP2012/063415

§ 371 (c)(1),
(2), (4) Date: Oct. 22, 2013

(87) PCT Pub. No.: WO2012/161296

PCT Pub. Date: Nov. 29, 2012

(65) Prior Publication Data

US 2014/0051277 A1 Feb. 20, 2014

(30) Foreign Application Priority Data

May 20, 2011 (JP) ..... 2011-113932

(51) Int. Cl.
*H01R 13/627* (2006.01)
*H01R 13/639* (2006.01)
*H01R 13/629* (2006.01)
(Continued)

(52) U.S. Cl.
CPC ..... *H01R 13/639* (2013.01); *H01R 13/627* (2013.01); *H01R 13/6275* (2013.01); *H01R 13/62933* (2013.01); *H01R 13/633* (2013.01); *H01R 13/641* (2013.01)

(58) Field of Classification Search
CPC ..... H01R 13/627; H01R 13/6275
USPC ..... 439/350
See application file for complete search history.

(56) References Cited

U.S. PATENT DOCUMENTS 5,350,312 A * 9/1994 Kuno et al. ..... 439/310
5,417,579 A 5/1995 Yoshioka et al.
(Continued)

FOREIGN PATENT DOCUMENTS

DE 4343209 A1 7/1994
DE 69401457 T2 8/1997
EP 0635908 A2 1/1995
(Continued)

OTHER PUBLICATIONS

International Search Report for PCT/JP2012/063415 dated Sep. 3, 2012 [PCT/ISA/210].
(Continued)

*Primary Examiner* — Abdullah Riyami
*Assistant Examiner* — Justin Kratt
(74) *Attorney, Agent, or Firm* — Sughrue Mion, PLLC

(57) ABSTRACT

A half fitting prevention connector includes a cylindrical case, a connector body, a lever, and a release lever. The release lever has a lock hole. An electromagnetic coil has a plunger. The plunger is arranged so as to face a microswitch. The electromagnetic coil is excited by connection between the signal terminal of the connector body and a signal terminal of a mating connector, and thereby moving the plunger toward the microswitch. The release lever is rotatable so that the plunger can enter the lock hole to press the microswitch in a state that the connector body is completely fitted with the mating connector and the plunger cannot enter the lock hole in a state that the connector body is half fitted with the mating connector.

3 Claims, 6 Drawing Sheets

(51) Int. Cl.
*H01R 13/633* (2006.01)
*H01R 13/641* (2006.01)

(56) References Cited

U.S. PATENT DOCUMENTS 5,435,748 A * 7/1995 Abe ..... 439/489
5,536,173 A * 7/1996 Fujitani et al. ..... 439/34

FOREIGN PATENT DOCUMENTS

JP 07-085926 A 3/1995
JP 10-262340 A 9/1998
JP 3321074 B2 6/2002

OTHER PUBLICATIONS

Written Opinion for PCT/JP2012/063415 dated Sep. 3, 2012 [PCT/ISA/237].
Office Action dated Feb. 24, 2015 issued by the Japanese Patent Office in counterpart Japanese Patent Application No. 2011-113932.
Office Action dated Dec. 16, 2014 issued by the Japanese Patent Office in counterpart Japanese Patent Application No. 2011-113932.
Office Action dated May 5, 2015 issued by the Chinese Patent Office in counterpart Chinese Patent Application No. 2012-80024603.4.

* cited by examiner

HALF FITTING PREVENTION CONNECTOR

TECHNICAL FIELD

The present invention relates to a power supply connector used in charging of, for example, an electric automobile, and to a half fitting prevention connector for preventing an arc discharge due to separation between terminals at the time of charging in a half fitted state from occurring by being constructed so that fitting work of both connectors of the power supplying side and the power receiving side is done with a low insertion force and charging is not started unless both connectors are completely fitted.

BACKGROUND ART

In a power supplying side connector fitted with a power receiving side connector fixed to an automobile body etc. of an automobile, the power supplying side connector with a low insertion force including a lever is publicly known (for example, see Patent Literature 1 (PTL 1)).

<Configuration of Power Supply Connector Described in PTL 1>

FIG. 6 is a longitudinal sectional view showing a power supply connector described in PTL 1.

In FIG. 6, a power supplying side connector 100 includes a cylindrical case 100C, a connector body 100M which is slidably attached to the front half part of the cylindrical case 100C and advances against a repulsive force of a coil spring 100S by pressing the back end to a handle 100H and internally receives plural terminals, the handle 100H pivoted by a pin 100P2 inserted into a horizontally long hole of the back half part of the cylindrical case 100C, a lever 100L in which the middle is pivotally attached inside the cylindrical case 100C by a lever shaft 100P1 and the distal end is pivoted by the pin 100P2 inserted into the horizontally long hole of the cylindrical case 100C and a shaft hole of the handle 100H, and a release lever 101 for inhibiting a turn of the lever 100L in a state that the connector body 100M is fitted with the mating connector, and when the lever 100L is gripped to the side of the handle 100H, the action side distal end of the lever 100L turns counterclockwise around the lever shaft 100P1 and the connector body 100M is advanced in a direction of the mating connector to be fitted with the mating connector.

At the completion of fitting, as shown in an enlarged view of FIG. 6(1), a locking protrusion 101K formed on the distal end of the release lever 101 engages with a locking step 100K formed on the distal end of an action part of the lever 100L, and the lever 100L is locked by the release lever 101.

CITATION LIST

Patent Literature

[PTL 1] JP-A-7-85926

<Problem of Power Supply Connector Described in PTL 1>

In the case of fitting and manipulating the power supply connector 100, it is normally constructed so that the power supply connector 100 can be fitted by gripping the lever 100L, but an interference friction may occur between both connector housings during manipulation of fitting into the mating connector 200 in the case of gripping the lever 100L. The interference friction is, for example, an interference friction between a connector housing 200C1 of the mating connector and a connector housing 100C1 shown in a circle A of FIG. 6 or an interference friction between a connector housing 200C2 of the mating connector and a connector housing 100C2 shown in a circle B of FIG. 6. When such interference friction occurs, the lever 100L stops in a state that the lever 100L is not gripped completely, and this does not reach a state in which the locking protrusion 101K of the distal end of the release lever 101 shown in the enlarged view of FIG. 6(1) engages with the locking step 100K of the lever 100L, and causes a state in which the locking protrusion 101K of the distal end of the release lever 101 shown in an enlarged view of FIG. 6(2) half engages with the locking step 100K of the lever 100L. In such a half engaging state, a power terminal 100T of the connector is mutually connected to a power terminal 200T of the mating connector (see a circle C of FIG. 6), but the lever 100L stops in the half engaging state, so that the lever 100L is not locked. As a result, application of some shock may cause a situation in which the locking protrusion 101K of the distal end of the release lever 101 disengages from the locking step 100K of the lever 100L to return to the original position from the half engaging state. Then, the power terminal 100T of the connector is disconnected from the power terminal 200T of the mating connector from the mutually connected state of the terminals (that is, a state in charging), so that the power terminal 100T is also detached from the power terminal 200T of the mating connector and in the case of detachment, an arc discharge may occur between the terminals to damage the terminals.

SUMMARY OF INVENTION

Technical Problem

The invention has been implemented to solve the problem described above, and an object of the invention is to prevent an arc discharge from occurring between terminals by preventing a charging current from flowing in a state of the half fitted condition by the configuration of the lever even when the interference friction occurs between both connector housings during manipulation of fitting with a mating connector in a state that the lever is not gripped completely.

Solution to Problem

In order to achieve the object, the present disclosure of (1) to (3) relates to a half fitting prevention connector and is characterized by the following.

(1) A half fitting prevention connector includes a cylindrical case, a connector body that is slidably accommodated in a front half part of the cylindrical case and has a signal terminal, a lever that is rotatably attached to the cylindrical case, and a release lever having an engaging piece which engages with a locking piece for preventing a returning operation of the lever or the connector in a state that the connector body is fitted with a mating connector by a rotational operation of the lever. The release lever has a lock hole. An electromagnetic coil having a plunger is provided on the cylindrical case. A microswitch for starting charging by a pressing operation of the plunger is provided on the cylindrical case, the plunger being arranged so as to face the microswitch. The electromagnetic coil is excited by connection between the signal terminal of the connector body and a signal terminal of a mating connector, and thereby moving the plunger toward the microswitch. The release lever is rotatable so that the plunger can enter the lock hole to press the microswitch in a state that the connector body is completely fitted with the mating connector and the plunger cannot enter the lock hole in a state that the connector body is half fitted with the mating connector.

(2) For example, the release lever can be manipulated by releasing excitation of the electromagnetic coil when the charging is the completed.

(3) For example, a lock arm is branched from the release lever, and the lock hole is formed in the lock arm.

Advantageous Effects of Invention

According to the present disclosure of the above (1) as described above, even when the interference friction occurs between both connector housings and the electromagnetic coil is excited in the half fitted state in which the lever is not gripped completely, the plunger cannot enter the lock hole, so that the microswitch is not operated and accordingly charging is not started, with the result that an arc discharge does not occur between the terminals (since a charging current does not flow originally) when the lever returns from the half fitted state to the original state and the terminals are separated.

According to the present disclosure of the above (2), the electromagnetic coil for malfunction prevention can also be used as a member for half fitting prevention.

According to the present disclosure of the above (3), flexibility of the layout of the electromagnetic coil improves by selecting the lock arm in any shape and length.

BRIEF DESCRIPTION OF DRAWINGS

FIG. 1A is a front view of the half fitting prevention connector before fitting, FIG. 1B is a longitudinal sectional view of a main part of the half fitting prevention connector at the time of completely fitting, and FIG. 1C is a front view in the vicinity of a microswitch in FIG. 1B.

DESCRIPTION OF EMBODIMENTS

<Half Fitting Prevention Connector According to the Present Disclosure>

Next, a half fitting prevention connector according to the present disclosure will be described based on FIGS. 1A to 1C.

Figure 1A:
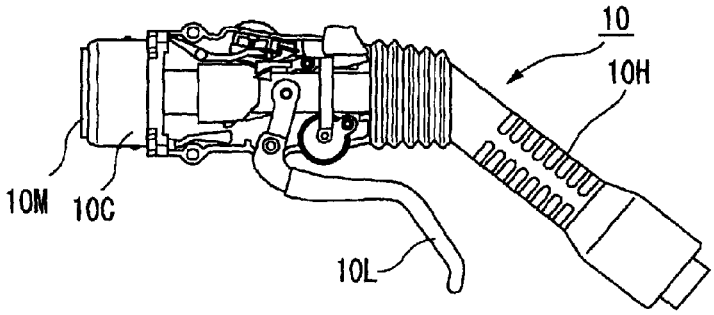
FIGS. 1A to 1C are views describing a half fitting prevention connector according to the present disclosure.
Figure 1B:
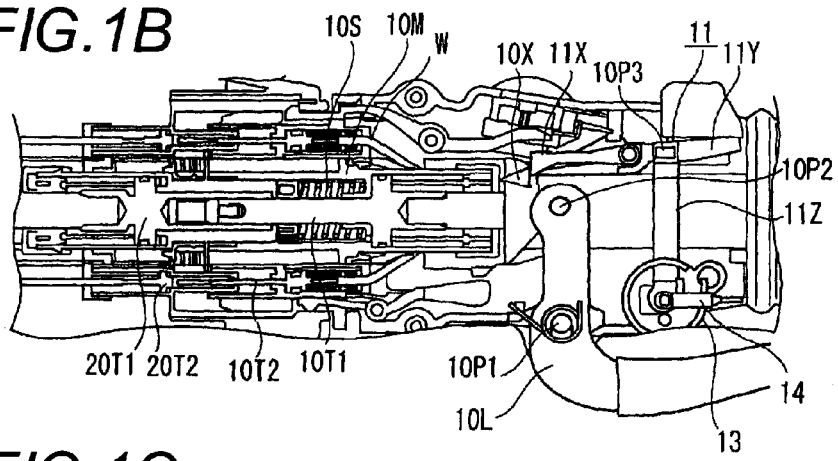
Figure 1C:
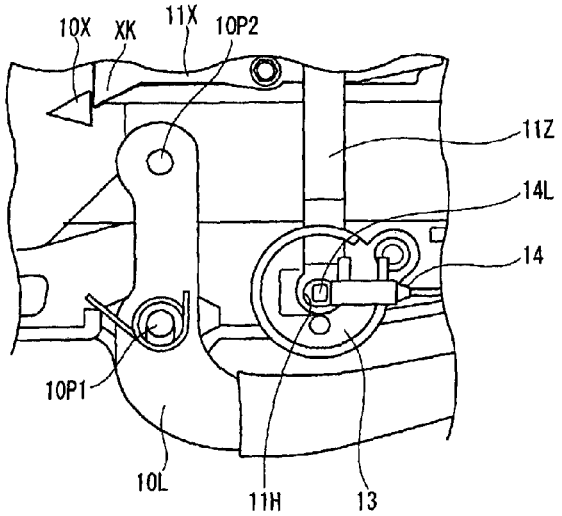

FIGS. 1A to 1C are views describing the half fitting prevention connector according to the present disclosure, and FIG. 1A is a front view of the half fitting prevention connector before fitting, FIG. 1B is a longitudinal sectional view of a main part of the half fitting prevention connector at the time of completely fitting, and FIG. 1C is a front view in the vicinity of a microswitch in FIG. 1B. In FIG. 1, the half fitting prevention connector 10 is a power supplying side connector fitted with a power receiving side connector of an automobile-mounted battery, and includes a cylindrical case 10C, a connector body 10M, a lever 10L, a handle 10H and a release lever 11. The cylindrical case 10C, the connector body 10M, the lever 10L, the handle 10H and the release lever 11 will hereinafter be described based on FIG. 1.

<Cylindrical Case 10C>

The connector body 10M (FIG. 1A) is slidably accommodated in the front half part of the cylindrical case 10C, and the handle 10H is pivoted by a pin 10P2 (FIG. 1B) inserted into a horizontally long hole of the back half part of the cylindrical case 10C and further, the middle of the lever 10L is pivotally attached by a lever shaft 10P1 (FIG. 1B).

<Connector Body 10M>

The connector body 10M internally receives plural power terminals 10T1 (FIG. 1B) and plural communication terminals 10T2 (FIG. 1B), and is slidably accommodated in the front half part of the cylindrical case 10C. The connector body 10M is always urged backward (in a direction opposite to fitting) by a repulsive force of a coil spring 10S, but advances in the cylindrical case 10C in a fitting direction by pressing the back end of the connector body 10M against the repulsive force of the coil spring 10S by the handle 10H.

<Lever 10L>

Figure 2:
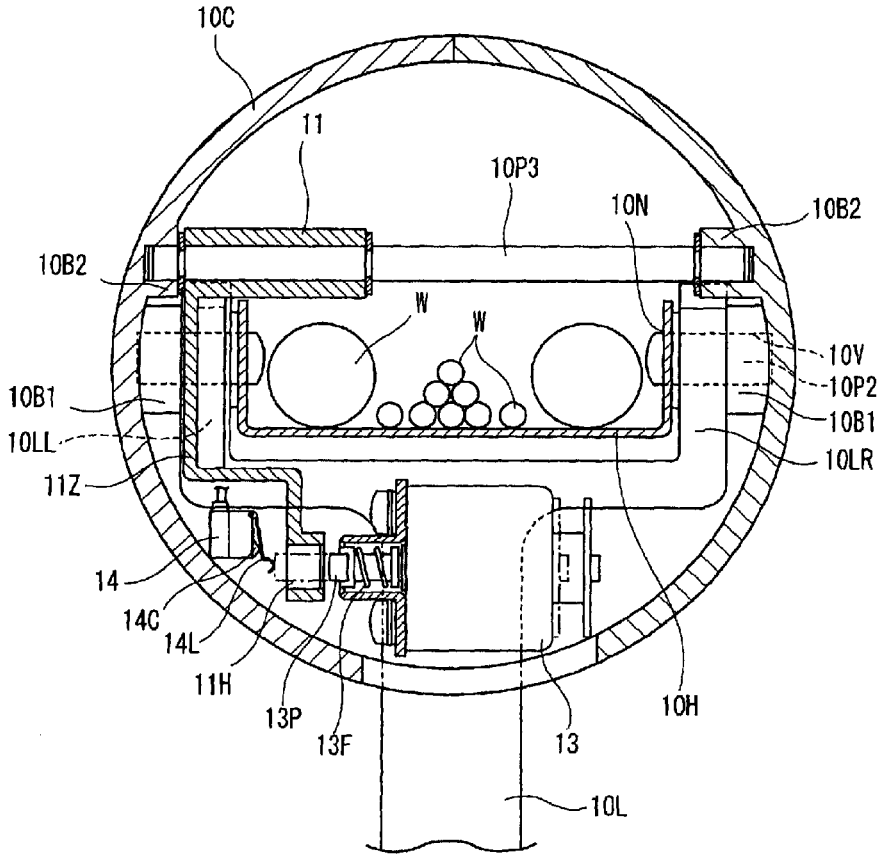
FIG. 2 is a longitudinal sectional view taken on a plane perpendicular to a shaft direction of the back half part of a cylindrical case.

The middle of the lever 10L is pivotally attached to the back half part of the cylindrical case 10C by the lever shaft 10P1, and the distal end of the lever 10L is formed in bifurcated lever support pieces 10LR, 10LL (see FIG. 2), and the lever support pieces 10LR, 10LL are pivoted by the pin 10P2 (FIG. 1B) inserted into the horizontally long hole formed in an inner wall of the cylindrical case 10C and a shaft hole formed in a side wall of the handle 10H (described in detail in FIG. 2).

<Handle 10H>

The handle 10H is a tubular long body with a substantially L shape, and the distal end of the handle 10H has a trough shape (see FIG. 2), and plural electric wire cables W of various sizes are inserted into this trough-shaped inside, and the respective distal ends of the electric wire cables W are connected to the power terminals 10T1 or the communication terminals 10T2 of the inside of the connector body 10M.

The handle 10H is pivoted in the cylindrical case 10C together with the distal end of the lever 10L by the pin 10P2 inserted into the horizontally long hole of the back half part of the cylindrical case 10C. Then, a side surface of the handle 10H is provided with a locking piece 10X (FIG. 1C) made of a triangular member, and this locking piece 10X is constructed so as to engage with a locking claw XK (FIG. 1C) formed in the distal end of an action arm 11X (FIG. 1B) of the release lever 11 (FIG. 1B) in a state that the mutual connectors are completely fitted.

Therefore, when the lever 10L is gripped to the side of the handle 10H, the distal end of the lever 10L turns counterclockwise around the lever shaft 10P1 in the drawing, and the handle 10H is advanced and the advanced handle 10H presses the back end of the connector body 10M, and the connector body 10M is advanced in the cylindrical case 10C against the repulsive force of the coil spring 10S and is fitted with the mating connector (power receiving side connector).

<Release Lever 11>

The release lever 11 is means for inhibiting the return of the lever 10L after the connector body 10M becomes fitted with the mating connector by gripping the lever 10L.

As shown in FIG. 1B, the release lever 11 is formed in substantially a T shape by the action arm 11X extending in a shaft direction of the connector body 10M, a manipulation arm 11Y projecting to the back outside of the cylindrical case 10C and a lock arm 11Z extending just downwardly from the middle of both of the arms, and the middle of these arms is turnably held by a pin 10P3 interposed in the cylindrical case 10C over the handle 10H.

Next, the action arm 11X, the manipulation arm 11Y and the lock arm 11Z will be described.

<<Action Arm 11X>>

The downward locking claw XK is formed in the distal end of the action arm 11X, and the action arm 11X is always urged downwardly in the drawing by the coil spring formed in the inner wall of the cylindrical case 10C. As the handle 10H is advanced, the locking piece 10X formed on the side surface of the handle 10H is also advanced and finally engages with the locking claw XK of the action arm 11X in a state that the mutual connectors are completely fitted and thereafter, the release lever 11 inhibits the handle 10H from being retracted. In the case of retracting the handle 10H, the following manipulation arm 11Y is depressed.

<<Manipulation Arm 11Y>>

The manipulation arm 11Y projects from the back of the cylindrical case 10C to the outside and when the manipulation arm 11Y is depressed, the action arm 11X of the release lever 11 is swung clockwise and is released from locking in the handle 10H.

<<Lock Arm 11Z>>

The lock arm 11Z has a lock hole 11H (FIG. 1C) in the lower end.

In a completely fitted state, the lock hole 11H of the lock arm 11Z is positioned on a moving course of a plunger 13P (see FIG. 2) of an electromagnetic coil 13, but in a half fitted state, the lock arm 11Z is slightly shifted from a normal position and the lock hole 11H is displaced from the moving course of the plunger 13P (see FIG. 2) of the electromagnetic coil 13.

Also, excitation of the electromagnetic coil 13 is started when a system of the power supplying side decides that the connectors are fitted by connection between signal terminals of the power supplying side connector and the power receiving side connector.

Hence, in the completely fitted state, by excitation of the electromagnetic coil 13, the plunger 13P moves from the electromagnetic coil 13 and enters into this lock hole 11H and thereby, a turn of the lock arm 11Z is locked. Therefore, even when the lock arm 11Z attempts to be unlocked by depressing the manipulation arm 11Y of the release lever 11 accidentally during power supplying, the action arm 11X cannot move since the lock arm 11Z is locked by the plunger 13P of the electromagnetic coil 13, with the result that the handle 10H and the lever 10L are also maintained in a locked state, so that detachment at the time of power supplying is prevented surely.

Also, when the electromagnetic coil 13 is demagnetized simultaneously with the completion of charging, the plunger 13P is retracted instantaneously by a resilient force of a coil spring 13F and the lock arm 11Z is unlocked.

Also, in the half fitted state, even when the plunger 13P protrudes from the electromagnetic coil 13 by excitation of the electromagnetic coil 13, the plunger 13P cannot enter the lock hole 11H and the lock arm 11Z is not locked.

In addition, the lock hole 11H may be formed in any region of the release lever 11 without forming the lock arm 11Z, but when the lock arm 11Z is formed thus, flexibility of the layout of the electromagnetic coil 13 improves by selecting the lock arm 11Z in any shape and length.

<Feature of the Present Disclosure: Installation of Microswitch in Distal End of Plunger>

The present disclosure is characterized in that a microswitch 14 (see FIG. 2) is installed in the distal end of the plunger 13P. A mounting structure and a function of this microswitch 14 will be described based on FIGS. 2 to 4.

FIG. 2 is a longitudinal sectional view taken on a plane perpendicular to a shaft direction of the back half part of the cylindrical case 10C, and the electromagnetic coil 13 in which the microswitch 14 is installed as a premise will be first described based on FIG. 2.

<Mounting Position and Function of Electromagnetic Coil 13>

In FIG. 2, in this cylindrical case 10C, the bifurcated lever support pieces 10LR, 10LL formed in the distal end of the lever 10L are pivoted by the pin 10P2 inserted into a horizontally long hole 10V of a boss 10B1 projected on an inner wall of the cylindrical case 10C and a shaft hole 10N formed in a side wall of the handle 10H.

<<Primary Lock>>

Grip manipulation of the lever 10L advances the handle 10H, and the handle 10H has trough shape in a longitudinal section in this region, and multiple electric wire cables W, W are received inside the handle 10H and pass through the connector body 10M. The advance of the handle 10H also presses the connector body 10M forward, and finally fits the connector body 10M into a power receiving side connector 20 and also, the release lever 11 locks the handle 10H and accordingly locks the lever 10L (primary lock).

<<Secondary Lock>>

The lock arm 11Z of the release lever 11 extends downward and has the lock hole 11H in the lower end, and the cylindrical case 10C is provided with the electromagnetic coil 13 as opposed to this lock hole 11H and when the electromagnetic coil 13 is excited in a completely fitted state, the plunger 13P is extended from the electromagnetic coil 13 and is inserted into the lock hole 11H to lock the lock arm 11Z (secondary lock). Also, by releasing excitation of the electromagnetic coil 13 at the completion of charging, the release lever 11 can be manipulated and the electromagnetic coil 13 for malfunction prevention can also be used as means for half fitting prevention.

Even when the electromagnetic coil 13 is excited in a half fitted state, the lock hole 11H of the lock arm 11Z is positioned on an operating line of the plunger 13P, so that the extended plunger 13P cannot be inserted into the lock hole 11H and accordingly, the lock arm 11Z is not locked.

<Mounting Structure of Microswitch 14 Adopted by the Present Disclosure>

Then, according to the present disclosure, the microswitch 14 is mounted in the cylindrical case 10C so as to be positioned in the distal end of the plunger 13P. The distal end of the plunger 13P is constructed so as to press a lever 14L in a state that the electromagnetic coil 13 is excited and the plunger 13P protrudes from the lock hole 11H of the lock arm 11Z. When the lever 14L is pressed, a moving contact 14C is pushed to turn on the microswitch 14 and charging is started.

Hence, when the system of the power supplying side decides that the connectors are fitted by connection between signal terminals of the power supplying side connector and the power receiving side connector, the electromagnetic coil 13 is excited and the plunger 13P protrudes from the lock hole 11H of the lock arm 11Z and presses the lever 14L of the microswitch 14 and the moving contact 14C is pushed to turn on the microswitch 14 and thereby, charging is started.

<Operation of Microswitch 14 Adopted by the Present Disclosure>

Figure 3A:
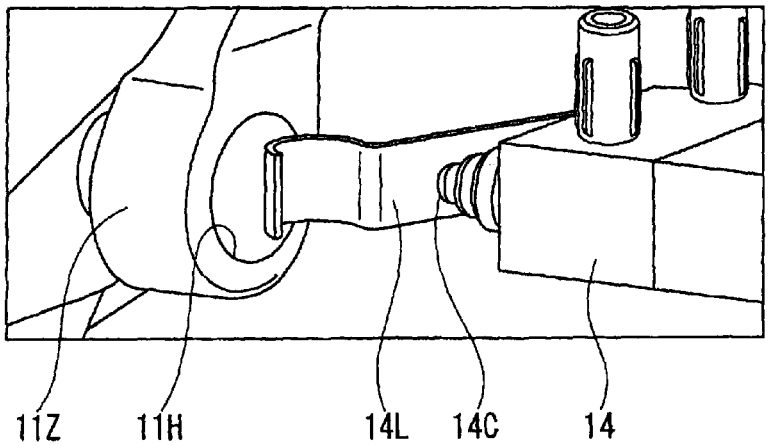
FIG. 3A is a perspective view of a state before the microswitch according to the present disclosure operates.
Figure 3B:
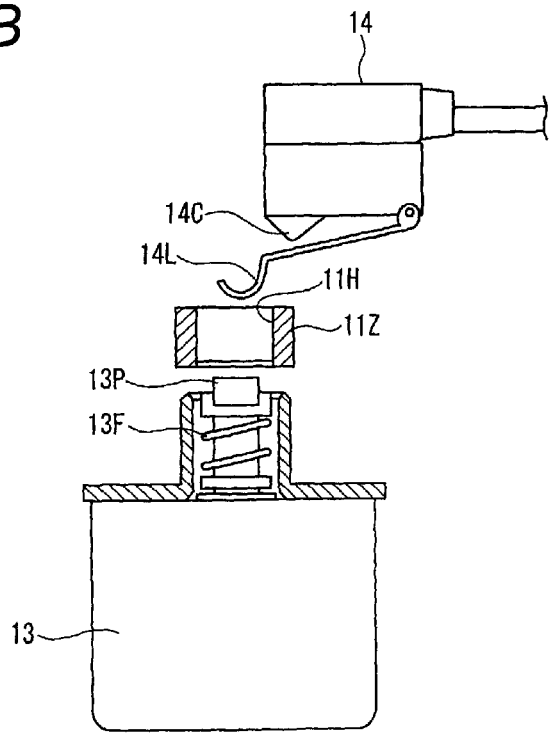
FIG. 3B is a partially sectional plan view in the vicinity of the microswitch of FIG. 3A.

Next, an operation of the microswitch 14 adopted by the present disclosure will be described based on FIGS. 3 to 5. FIG. 3A is a perspective view of a state before the microswitch operates, and FIG. 3B is a partially sectional plan view in the vicinity of the microswitch of FIG. 3A, and FIG. 4A is a perspective view of a state in which the microswitch according to the present disclosure operates in a completely fitted state, and FIG. 4B is a partially sectional plan view in the vicinity of the microswitch of FIG. 4A.

<<Case of Completely Fitting Power Supply Connector>>

Figure 4A:
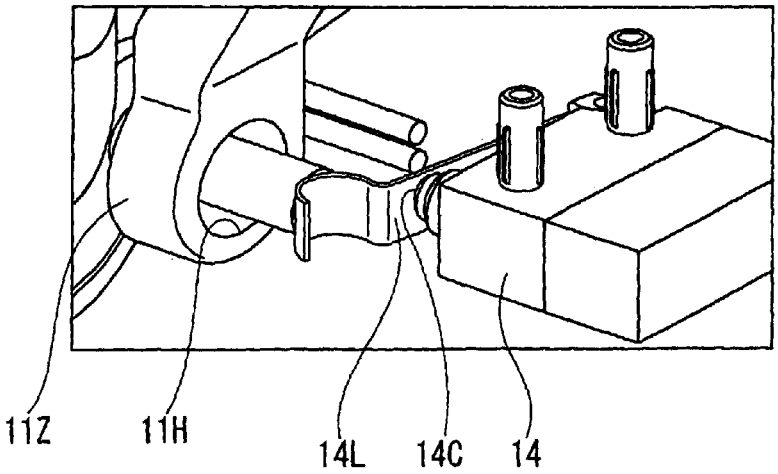
FIG. 4A is a perspective view of the case where the microswitch according to the present disclosure operates in a completely fitted state.
Figure 4B:
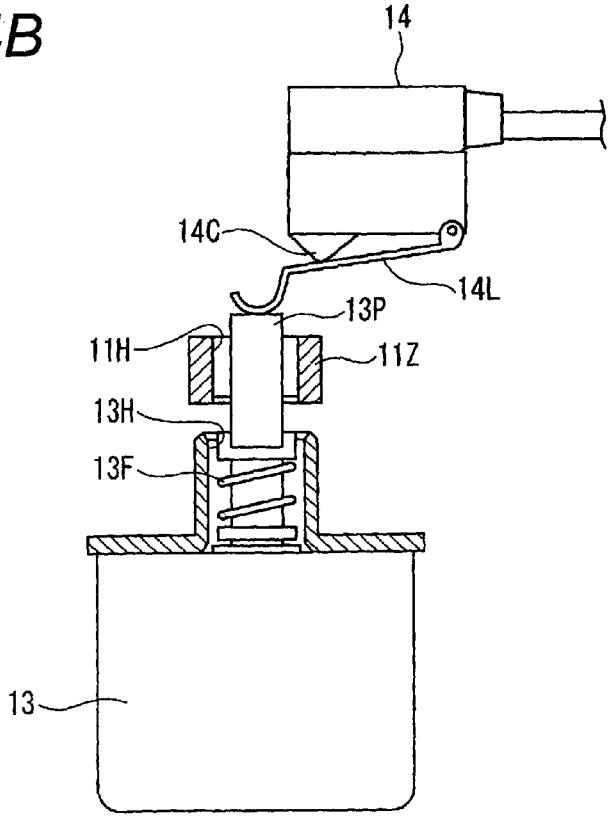
FIG. 4B is a partially sectional plan view in the vicinity of the microswitch of FIG. 4A.

When the lever 10L is further gripped and the mutual connectors are completely fitted (fully fitted), as shown in FIGS. 4A and 4B, the lock hole 11H of the lock arm 11Z is positioned on the operating line of the plunger 13P of the electromagnetic coil 13, so that when the electromagnetic coil 13 is excited by connection between the signal terminals, the plunger 13P enters the lock hole 11H of the lock arm 11Z and protrudes from the lock hole 11H and presses the lever 14L of the microswitch 14 and the moving contact 14C is pushed to turn on the microswitch 14 and charging is started.

Figure 6:
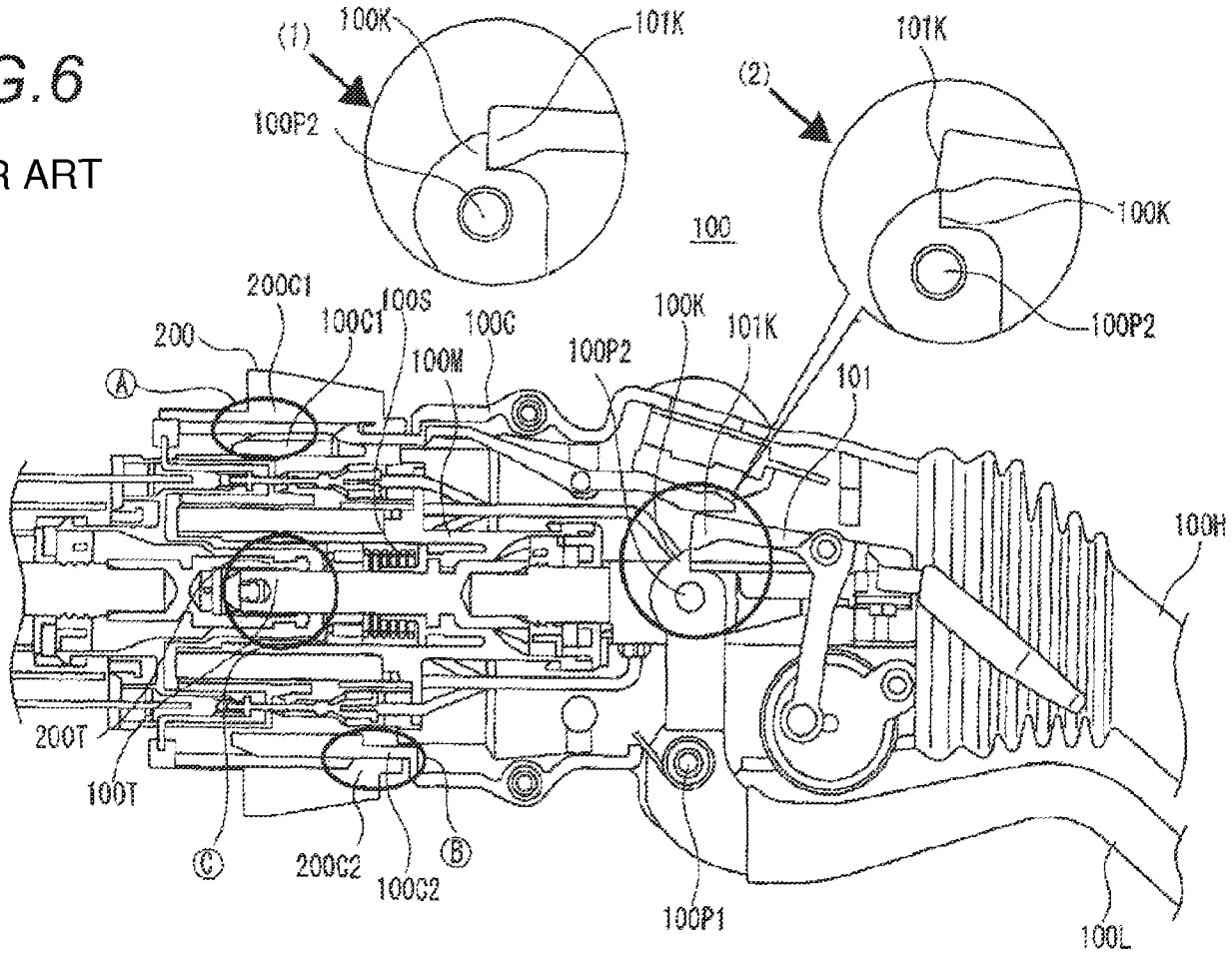
FIG. 6 PRIOR ART
FIG. 6 is a front view showing a connector with a handle described in PTL 1.

Conventionally, the electromagnetic coil is excited and also charging is started when the system of the power supplying side decides that the connectors are fitted by connection between the signal terminals of the connectors. In this case, as described in FIG. 6(2), charging is started in a half fitted state in which the lever is not gripped completely, so that subsequent separation between the power terminals causes trouble in which an arc discharge occurs.

However, according to the present disclosure, even when the system of the power supplying side decides that the connectors are fitted by connection between the signal terminals of the connectors and the electromagnetic coil is excited, charging is not started yet. Then, when the plunger 13P presses the lever 14L of the microswitch 14 by excitation of the electromagnetic coil 13, charging is started. The fact that the plunger 13P presses the lever 14L of the microswitch 14 means that the mutual connectors are in a completely fitted state and the lock arm 11Z is locked (in a state that the mutual connectors are half fitted, the lock arm 11Z is not locked since the lock hole 11H of the lock arm 11Z is displaced from the course of the plunger 13P), and the lock arm 11Z is locked, so that the mutual terminals are not separated and accordingly, an arc discharge does not occur.

<<Case of Half Fitting Power Supply Connector>>

Figure 5A:
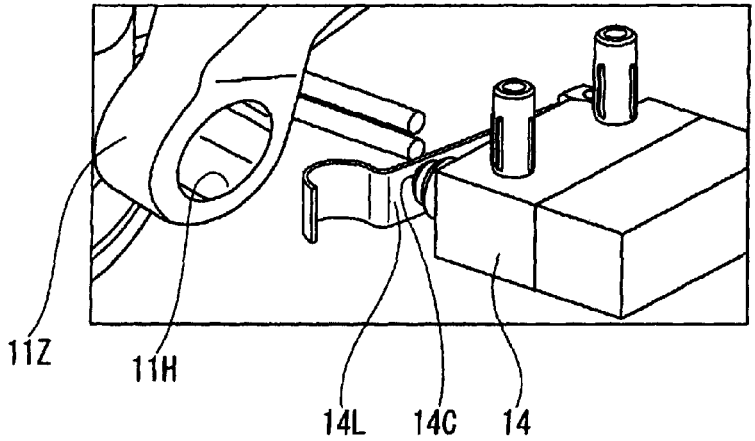
FIG. 5A is a perspective view of the case where the microswitch according to the present disclosure operates in a half fitted state.
Figure 5B:
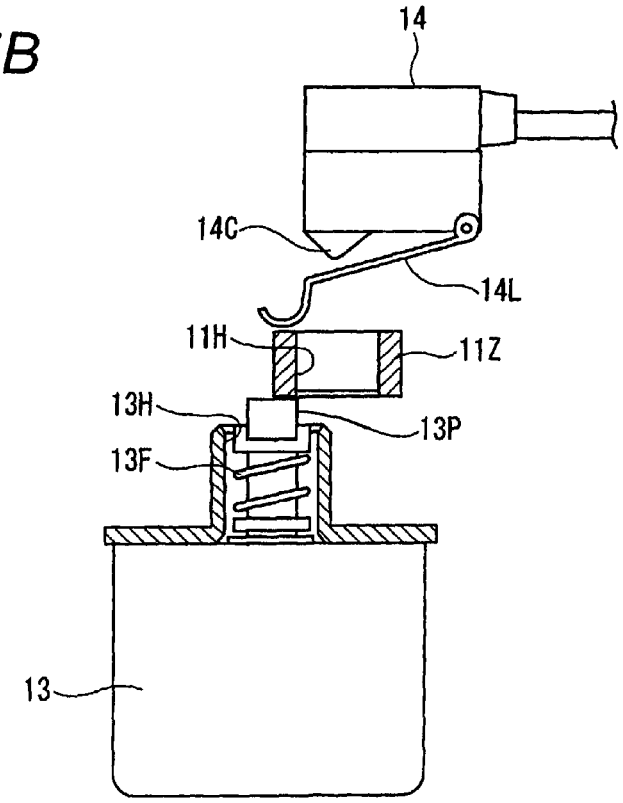
FIG. 5B is a partially sectional plan view in the vicinity of the microswitch of FIG. 5A.

FIG. 5A is a perspective view of the case where the microswitch according to the present disclosure operates in a half fitted state, and FIG. 5B is a partially sectional plan view in the vicinity of the microswitch of FIG. 5A. When the lever 10L is insufficiently gripped, the power supply connector is in a half fitted state and as shown in FIGS. 5A and 5B, the lock arm 11Z is displaced from a completely fitted position (see 11Z of FIGS. 5A and 5B) and accordingly, the lock hole 11H is not positioned on the operating line of the plunger 13P of the electromagnetic coil 13, so that even when the electromagnetic coil 13 is excited to operate the plunger 13P, the plunger 13P abuts on the peripheral edge of the lock hole 11H of the lock arm 11Z and cannot enter the lock hole 11H. Therefore, the lever 14L of the microswitch 14 does not make contact with the moving contact 14C, and a charging circuit remains off and charging is not started.

Hence, even when some shock is applied to detach the connectors, the arc discharge does not occur between the terminals since charging is not started originally.

<Conclusion>

According to the present disclosure as described above, when the electromagnetic coil 13 is excited to operate the plunger 13P, in the completely fitted state, the plunger 13P enters the lock hole 11H and presses the lever 14L of the microswitch 14 and charging is started. During the charging, the lock arm 11Z is locked, so that even when a shock is applied, the mutual power terminals are not separated and accordingly, an arc discharge does not occur. Also, in the half fitted state, the plunger 13P cannot enter the lock hole 11H, so that the plunger 13P cannot press the lever 14L of the microswitch 14 and accordingly, the microswitch 14 remains off and charging is not started.

Therefore, even when a shock is applied to separate the mutual power terminals in the half fitted state, the arc discharge does not occur since a charging current does not flow originally.

According to the present disclosure thus, in both cases of the completely fitted state and the half fitted state, the arc discharge does not occur between the terminals and there is no fear of damaging the terminals.

Also, by releasing excitation of the electromagnetic coil at the completion of charging, the release lever can be manipulated and the electromagnetic coil for malfunction prevention can also be used as means for half fitting prevention.

Also, flexibility of the layout of the electromagnetic coil improves by forming the lock arm branched from the release lever and selecting its lock arm in any shape and length.

The present application is based on Japanese Patent Application No. 2011-113932 filed on May 20, 2011, the contents of which are incorporated herein by reference.

INDUSTRIAL APPLICABILITY

By the above configuration of the present disclosure, an arc discharge prevention connector that prevents arc discharge from occurring on power terminals can be obtained.

REFERENCE SIGNS LIST

10: HALF FITTING PREVENTION CONNECTOR
10B1,10B2: BOSS
10C: CYLINDRICAL CASE
10H: HANDLE
10L: LEVER
10LR,10LL: LEVER SUPPORT PIECE
10M: CONNECTOR BODY
10N: SHAFT HOLE
10P1: LEVER SHAFT
10P2: PIN
10S: COIL SPRING
10T1: POWER TERMINAL
10T2: COMMUNICATION TERMINAL
10V: HORIZONTALLY LONG HOLE
10X: LOCKING PIECE
11: RELEASE LEVER
11H: LOCK HOLE
11X: ACTION ARM
11Y: MANIPULATION ARM
11Z: LOCK ARM
13: ELECTROMAGNETIC COIL
13F: COIL SPRING
13P: PLUNGER
14: MICROSWITCH
14C: MOVING CONTACT
14L: LEVER
W: ELECTRIC WIRE CABLE

The invention claimed is:

1. A half fitting prevention connector, comprising:
a cylindrical case;
a connector body that is slidably accommodated in a front half part of the cylindrical case and has a signal terminal;
a lever that is rotatably attached to the cylindrical case; and
a release lever having an engaging piece which engages with a locking piece for preventing a returning operation of the lever or the connector in a state that the connector body is fitted with a mating connector by a rotational operation of the lever, wherein the release lever has a lock hole;

wherein an electromagnetic coil having a plunger is provided on the cylindrical case;

wherein a microswitch for starting charging by a pressing operation of the plunger is provided on the cylindrical case, the plunger being arranged so as to face the microswitch;

wherein the electromagnetic coil is excited by connection between the signal terminal of the connector body and a signal terminal of a mating connector, and thereby moving the plunger toward the microswitch; and wherein the release lever is rotatable so that the plunger can enter the lock hole to press the microswitch in a state that the connector body is completely fitted with the mating connector and the plunger cannot enter the lock hole in a state that the connector body is half fitted with the mating connector.

2. The half fitting prevention connector according to claim 1, wherein the release lever can be manipulated by releasing excitation of the electromagnetic coil when the charging is the completed.

3. The half fitting prevention connector according to claim 1, wherein a lock arm is branched from the release lever; and wherein the lock hole is formed in the lock arm.

* * * * *